US008459244B2

(12) United States Patent
Yehle

(10) Patent No.: US 8,459,244 B2
(45) Date of Patent: Jun. 11, 2013

(54) CENTER-BEARING LIMBS FOR AN ARCHERY BOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 0 days.

(21) Appl. No.: 13/212,176

(22) Filed: Aug. 18, 2011

(65) Prior Publication Data

US 2012/0210991 A1 Aug. 23, 2012

Related U.S. Application Data

(63) Continuation of application No. 12/394,652, filed on Feb. 27, 2009, now abandoned.

(51) Int. Cl.
*F41B 5/00* (2006.01)
*F41B 5/10* (2006.01)

(52) U.S. Cl.
USPC ..... 124/25.6; 124/23.1

(58) Field of Classification Search
USPC ..... 124/23.1, 25.6, 86, 88
See application file for complete search history.

(56) References Cited

U.S. PATENT DOCUMENTS 4,183,345 A 1/1980 Caldwell
4,350,138 A 9/1982 Caldwell
4,955,354 A * 9/1990 Bozek ..... 124/23.1
5,024,206 A * 6/1991 Lester ..... 124/23.1
5,706,794 A * 1/1998 Neal ..... 124/25.6
6,019,097 A * 2/2000 Cox et al. ..... 124/23.1
6,029,644 A * 2/2000 Bronnert ..... 124/25.6
6,712,057 B2 * 3/2004 Andrews ..... 124/23.1
6,786,214 B2 * 9/2004 Andrews ..... 124/23.1
7,784,452 B1 * 8/2010 Kronengold et al. ..... 124/23.1
7,832,387 B1 11/2010 Yehle
8,047,189 B2 * 11/2011 McPherson ..... 124/23.1
2006/0011181 A1 * 1/2006 Andrews ..... 124/23.1

OTHER PUBLICATIONS

U.S. Appl. No. 12/394,652, filed Feb. 27, 2009, Yehle.

* cited by examiner

*Primary Examiner* — John Ricci
(74) *Attorney, Agent, or Firm* — David S. Alavi

(57) ABSTRACT

An archery bow comprises a riser and a pair of bow limbs. The riser has a central portion and first and second end portions, each including a corresponding forward pivotable connection point and rearward bearing point substantially rigidly positioned on the corresponding end portion. A bearing member is positioned at each corresponding rearward bearing point. Each bow limb has a riser connection point and a pulley connection point, and is (i) pivotably connected at its riser connection point to the corresponding riser end portion at its pivotable connection point, (ii) positioned against the corresponding bearing member at a point along the bow limb between its riser and pulley connection points that is displaced from the riser connection point by at least one third of the distance between the riser and pulley connection points, and (iii) arranged at its pulley connection point to receive a pulley member pivotably connected thereto.

18 Claims, 12 Drawing Sheets

FIG. 5A
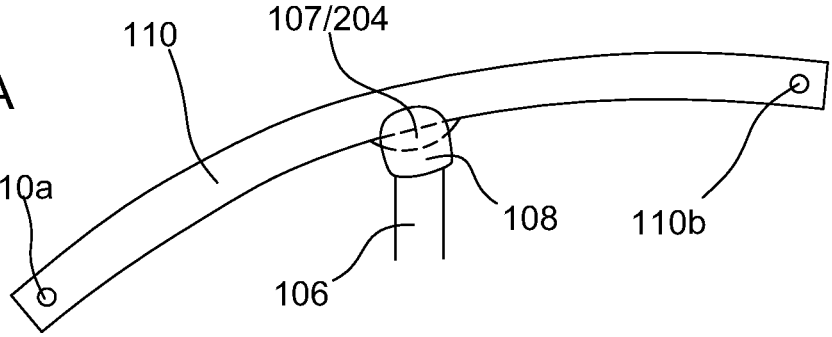
FIG. 5B
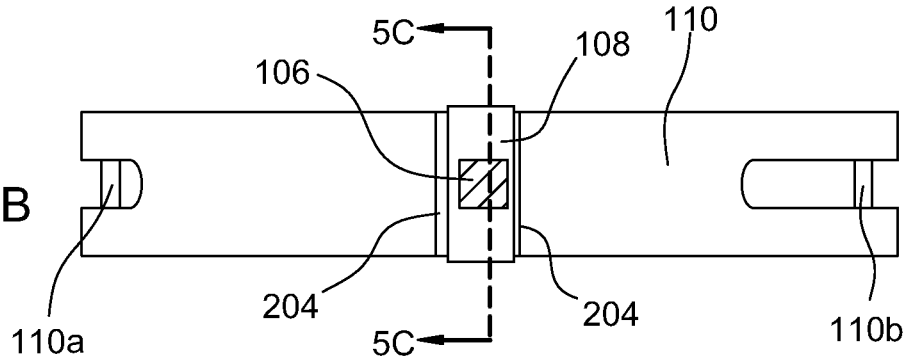
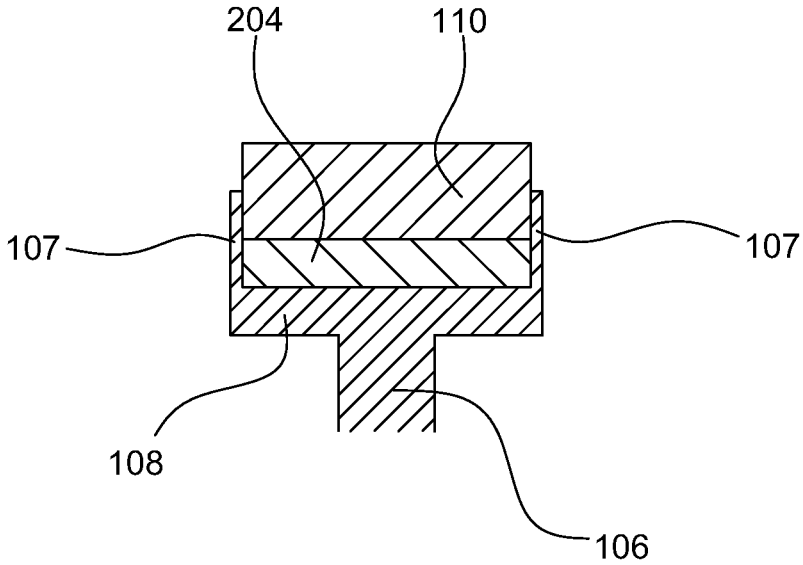
FIG. 5C

FIG. 6A
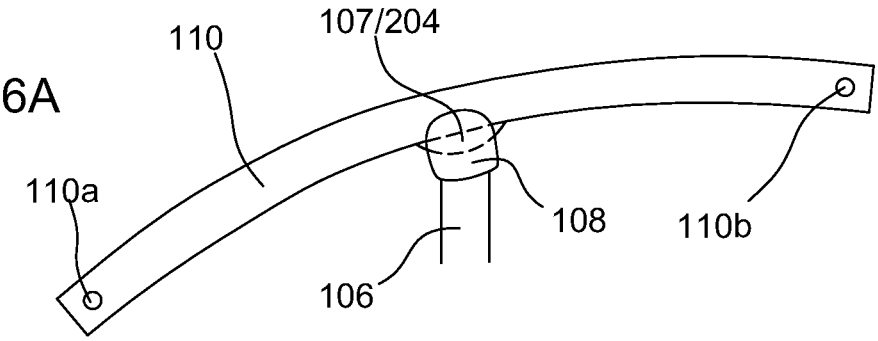
FIG. 6B
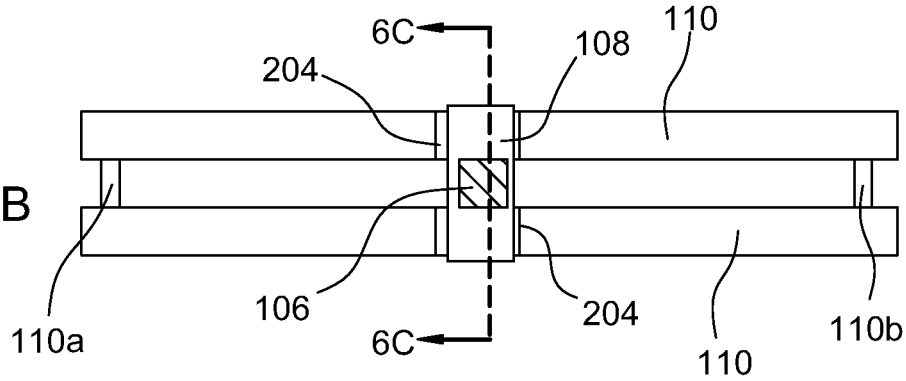
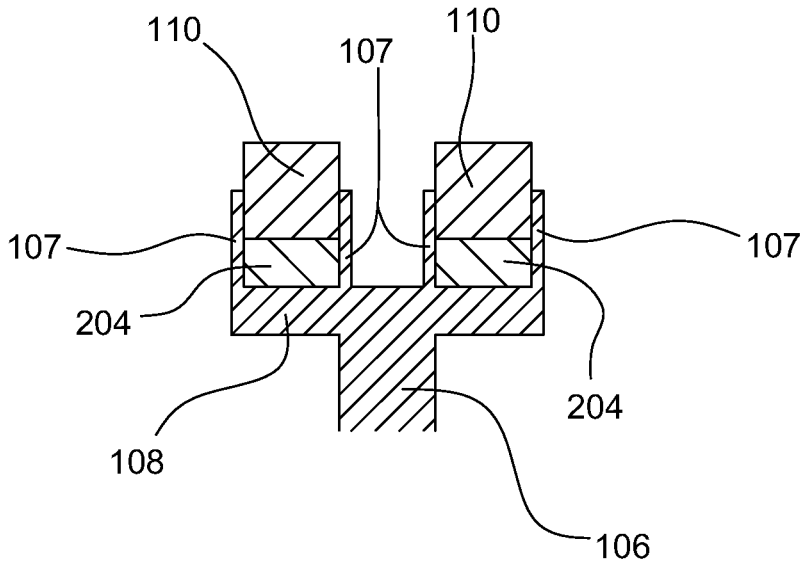
FIG. 6C

CENTER-BEARING LIMBS FOR AN ARCHERY BOW

BENEFIT CLAIM TO RELATED APPLICATION

This application is a continuation of prior-filed on-provisional application Ser. No. 12/394,652 filed Feb. 27, 2009 now abandoned in the name of Craig T. Yehle, said application being hereby incorporated by reference as if fully set forth herein.

BACKGROUND

The field of the present invention relates to archery bows. In particular, an archery bow having center-bearing limbs and methods for manufacturing an archery bow incorporating such limbs are disclosed herein.

Previous limbs for archery bows typically are secured near one end thereof to a riser, and can be referred to as end-pivot limbs for purposes of this disclosure. Upon drawing the bow, the limbs are deformed as the energy expended in drawing the bow is stored as strain energy of the deformed limbs. This energy is then released as kinetic energy of the arrow when the bow is shot and the limbs return to their original, unstrained shape.

End-pivot limbs typically are subject to localized forces and stresses that are substantially magnified by the lever arm of the limb (roughly, the overall limb length divided by the limb length in contact with the riser). The bending moment and effective moment of inertia typically are largest for a limb with a pivot point near one end. It may be desirable to provide a bow limb having a pivot point or bearing point nearer to the center of the limb than in previous bows.

SUMMARY

An archery bow comprises an elongated, substantially rigid riser and a pair of elongated bow limbs. The riser has a central portion and first and second end portions extending from its opposite ends. Each of the end portions includes a corresponding forward pivotable connection point and rearward bearing point, each substantially rigidly positioned on the corresponding end portion. A bearing member is positioned at each corresponding rearward bearing point. Each bow limb has a riser pivotable connection point and a pulley pivotable connection point, and is (i) pivotably connected at its riser connection point to the corresponding riser end portion at its pivotable connection point, (ii) positioned against the corresponding bearing member at a point along the bow limb between its riser and pulley connection points that is displaced from the riser connection point by at least one third of the distance between the riser and pulley connection points, and (iii) arranged at its pulley pivotable connection point to receive a pulley member pivotably connected thereto.

Objects and advantages pertaining to bows with center-bearing bow limbs may become apparent upon referring to the exemplary embodiments illustrated in the drawings or disclosed in the following written description or appended claims.

BRIEF DESCRIPTION OF THE DRAWINGS

FIGS. 5A-5C are side, bottom, cross-sectional views of an exemplary arrangement of the center-bearing limb of FIGS. 2A and 2B. The cross-sectional view of FIG. 5C is enlarged relative to the views of FIGS. 5A and 5B.

FIGS. 6A-6C are side, bottom, cross-sectional views of another exemplary arrangement of the center-bearing limb of FIGS. 2A and 2B. The cross-sectional view of FIG. 6C is enlarged relative to the views of FIGS. 6A and 6B.

Figure 1:
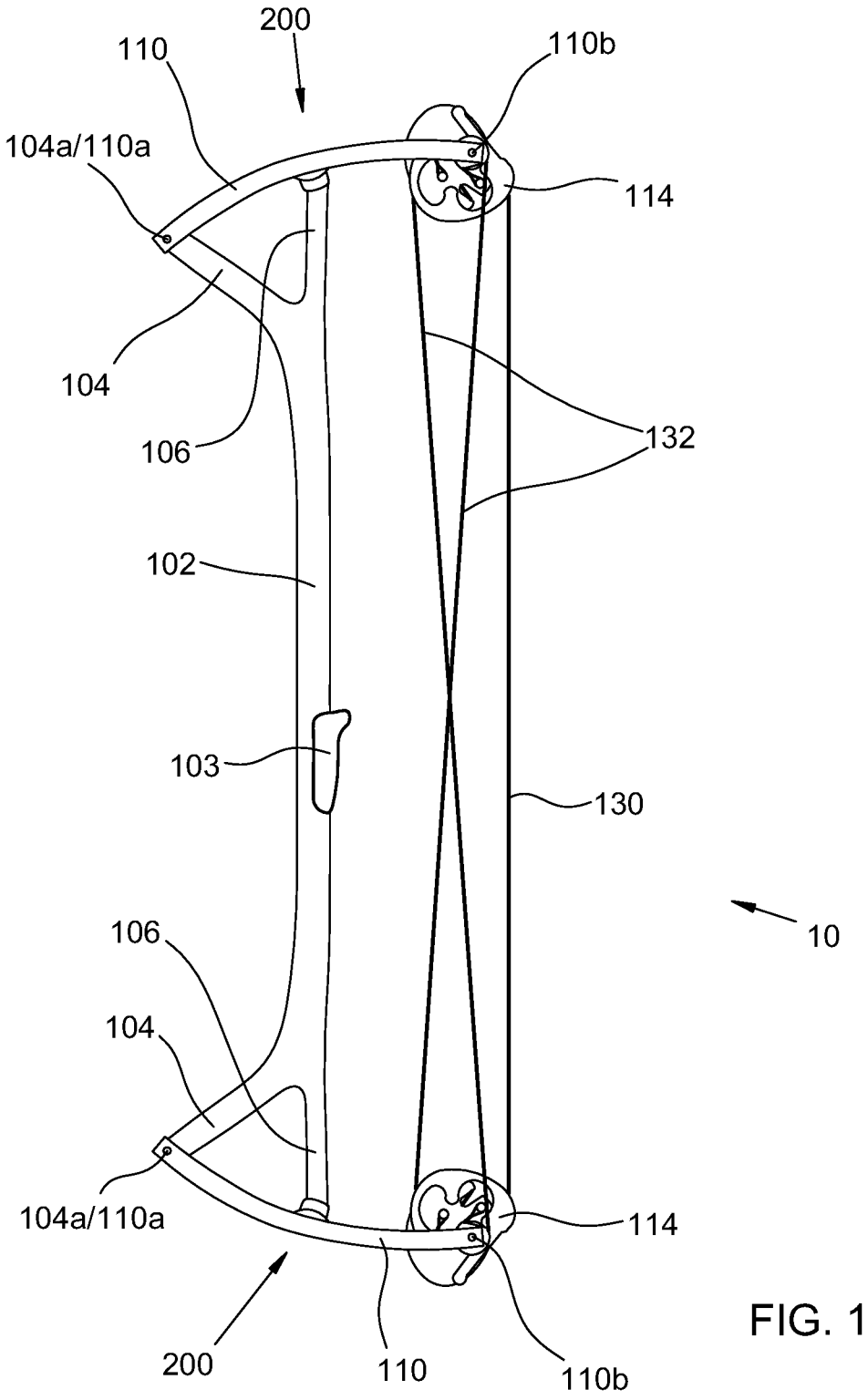
FIG. 1 illustrates schematically an exemplary embodiment of a bow with center-bearing limbs.
Figure 2A:
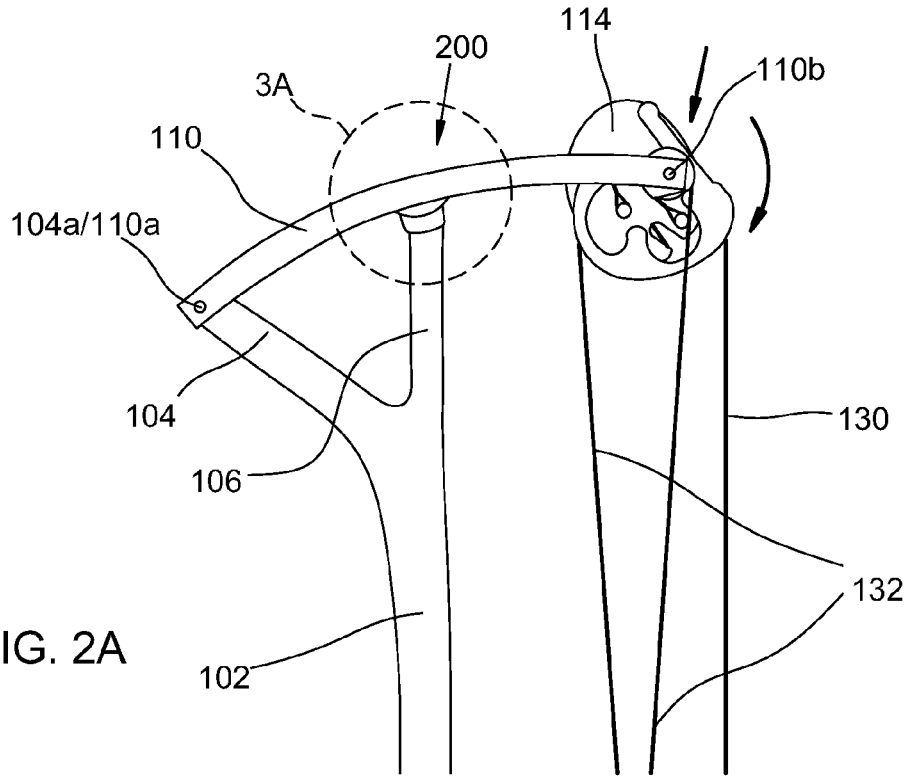
FIGS. 2A and 2B illustrate schematically an exemplary embodiment of a bow with center-bearing limbs in undrawn and drawn configurations.
Figure 2B:
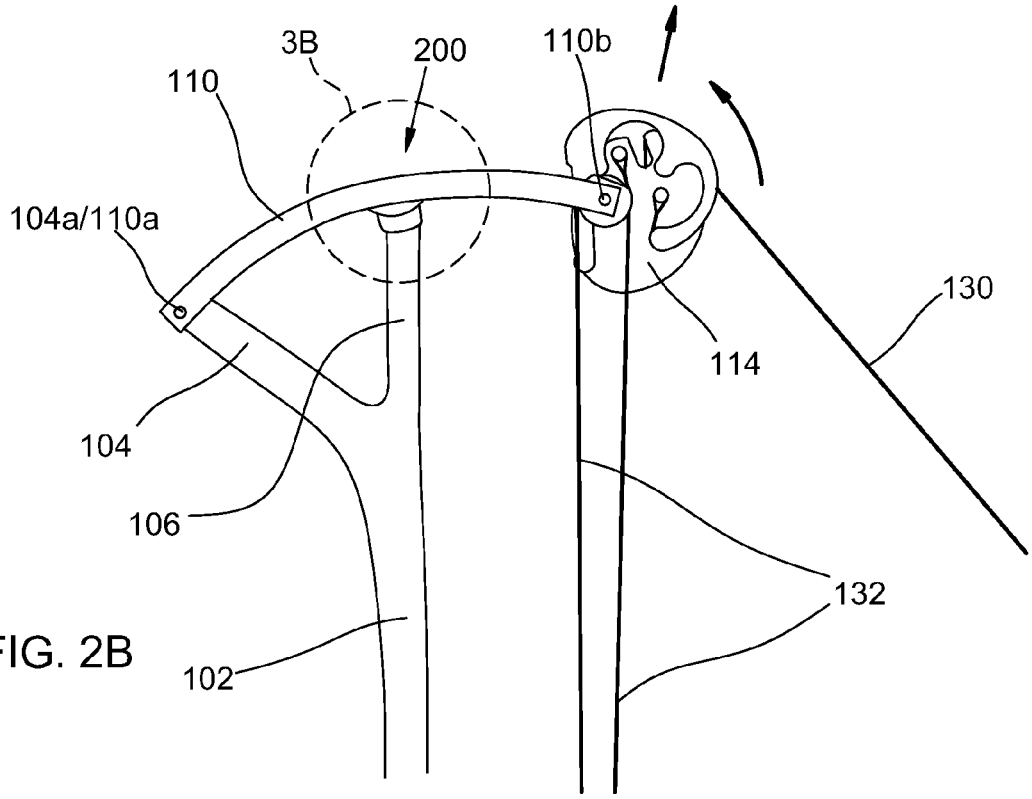
Figure 3A:
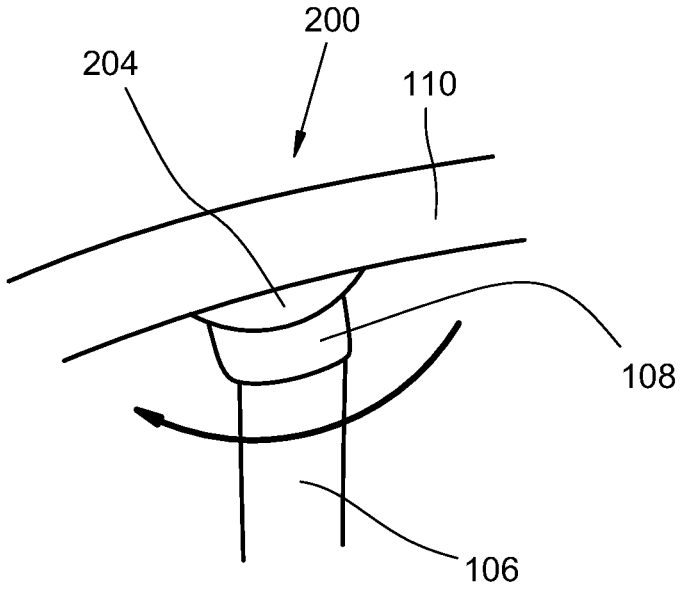
FIGS. 3A and 3B are enlarged views of corresponding portions of FIGS. 2A and 2B, respectively.
Figure 3B:
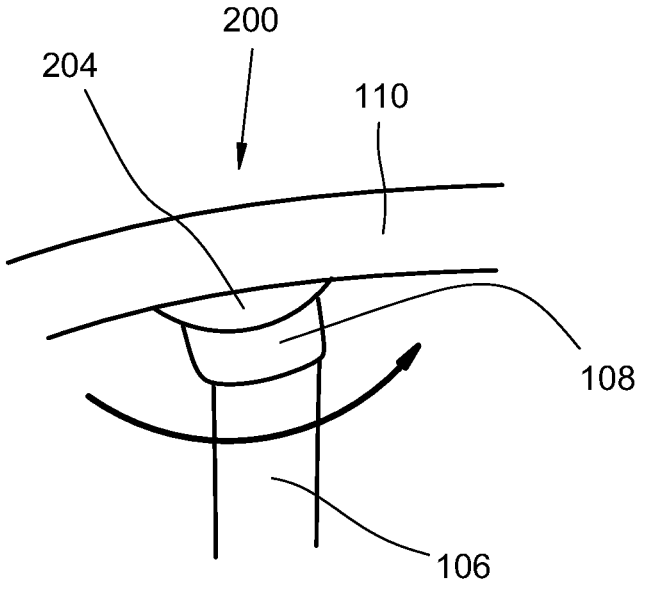
Figure 4A:
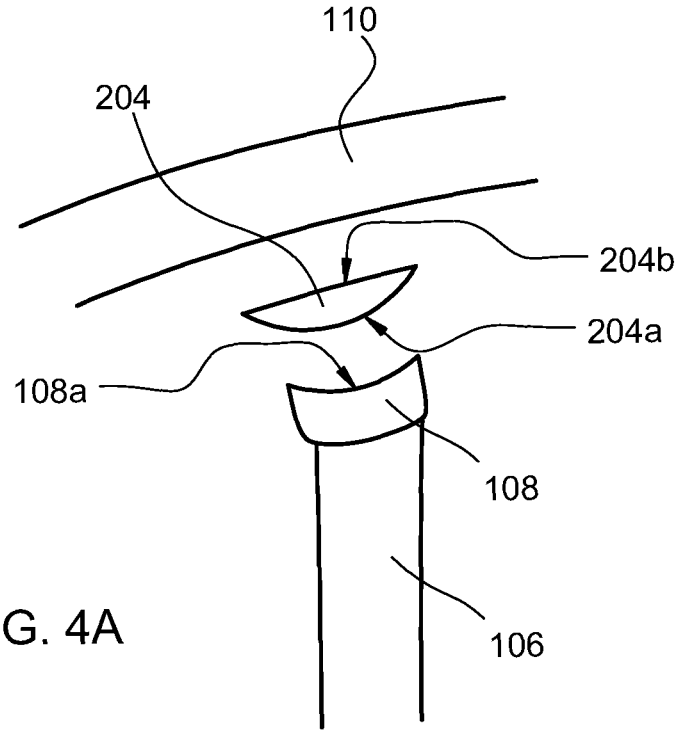
FIGS. 4A and 4B are enlarged, exploded views of corresponding portions of FIGS. 2A and 2B, respectively.
Figure 4B:
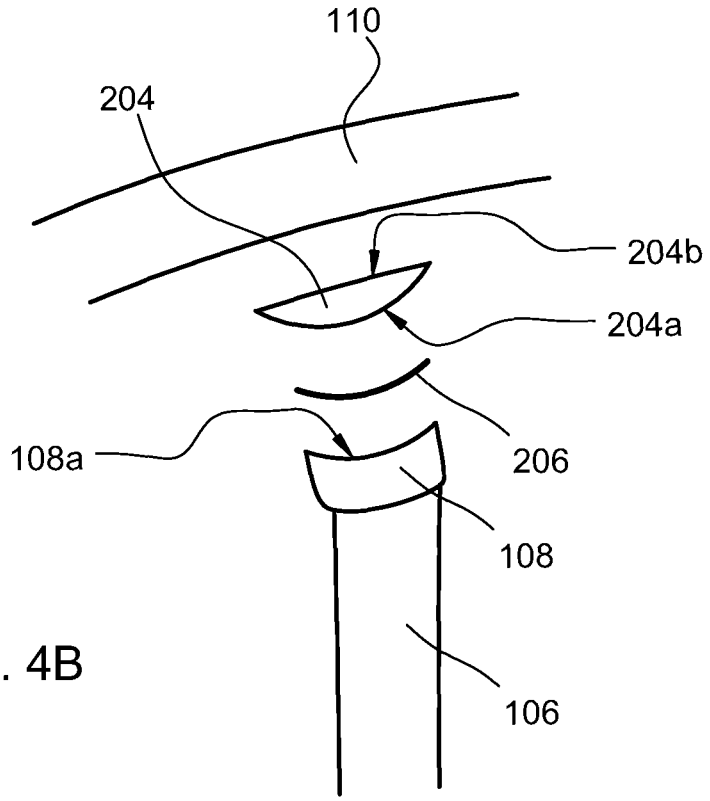
Figure 7A:
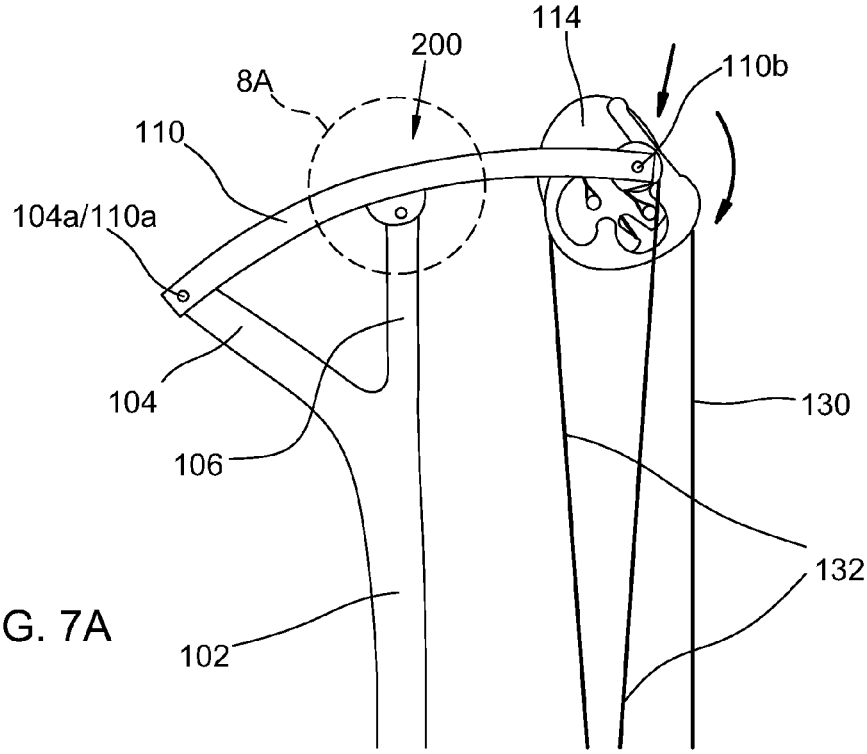
FIGS. 7A and 7B illustrate schematically another exemplary embodiment of a bow with center-bearing limbs in undrawn and drawn configurations.
Figure 7B:
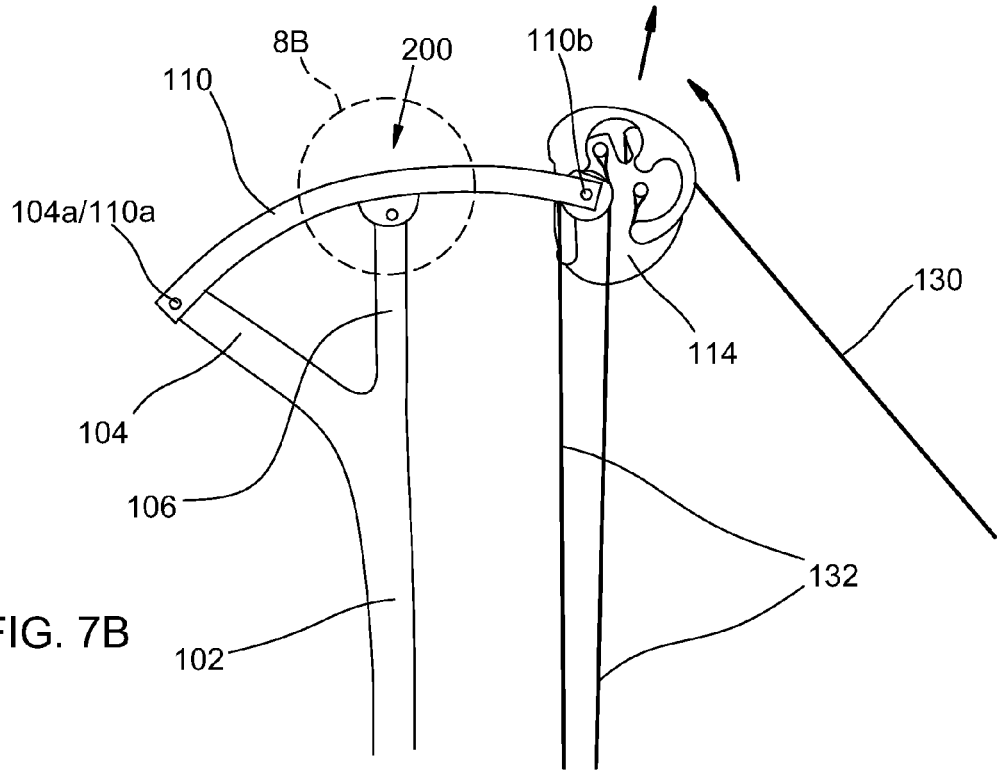

The embodiments shown in the Figures are exemplary only, and should not be construed as limiting the scope of the present disclosure or appended claims.

DETAILED DESCRIPTION OF EMBODIMENTS

A first exemplary embodiment of an archery bow 10 incorporating center-bearing limbs is illustrated schematically in FIGS. 1, 2A, 2B, 3A, 3B, and 11A-11F. A second exemplary embodiment of archery bow 10 incorporating center-bearing limbs is illustrated schematically in FIGS. 7A, 7B, 8A, and 8B. A third exemplary embodiment of archery bow 10 incorporating center-bearing limbs is illustrated schematically in FIGS. 9A, 9B, 10A, and 10B. While the term "center-bearing" is used herein to describe the disclosed bow limbs, it is not necessarily the case that the bow limb has a bearing point precisely at its center; a center-bearing limb as disclosed herein has a bearing point somewhere along its length between two pivot points thereon, as described hereinbelow. The term "point" is used herein to denote a location of a pivotable connection or a bearing, and is not intended to be restricted to an infinitesimal geometric point, but can refer to a connection or contact location that spans a finite, limited length, area, or volume.

In each embodiment the bow comprises an elongated riser 102 with a central portion and bifurcated end portions, two bow limbs 110, and two pulley members 114. The bifurcated end portions of riser 102 and the bow limbs 110 typically are substantially identical and substantially symmetrically arranged on bow 10, but this need not always be the case. Such a symmetrical arrangement is assumed in the following discussion, but asymmetric arrangements shall also fall within the scope of the present disclosure or appended claims. The central portion of riser 102 can include a handle 103. Alternatively, if the bow is a crossbow (not shown) the central portion of riser 102 can include a connection to a crossbow rail.

One or both of the pulley members 114 can comprise a cam assembly including a journal for letting out draw string 130. Such a cam assembly can also include a journal for taking up or letting out a power cable 132, or can include additional journals, posts, or other functionally equivalent structures, e.g., for letting out a let-out/take-up cable in a single-cam bow, for taking up or letting out a power cable in a single- or dual-cam bow, and so on. Alternatively, one or both of the pulley members 114 can comprise an idler wheel. The example in FIG. 1 is a Binary Cam® bow, in which both pulley members are cam assemblies that take up one power cable while letting out another. Any compound bow configuration, known or future-developed, shall fall within the scope of the present disclosure or appended claims, including but not limited to single-cam bows, dual-cam bows, Binary Cam® bows, hybrid cam bows, or bows having idler wheels on both limbs. Any suitable combination or arrangement of pulley members, cam assemblies, idler wheels, draw cables, power cables, let-out/take-up cables, or similar elements can be employed within the scope of the present disclosure or appended claims.

In various of the exemplary embodiments of bow 10, the elongated riser 102 has first and second bifurcated end portions extending from its opposite ends. Each bifurcated end portion comprises corresponding forward riser segment 104 and rearward riser segment 106. The riser segments 104 and 106 are substantially rigid and are substantially rigidly connected to the riser 102. The riser and its bifurcated end portions can be integrally formed as a single, unitary part, or they can be assembled from multiple, separate parts substantially rigidly connected together. Any suitably rigid material can be employed for forming the riser 102 and its bifurcated end portions, including but not limited to metals, metal alloys, composites, wood, or other suitable materials. Each forward riser segment 104 includes a corresponding pivotable connection point 104*a*, which typically comprises a transverse hole for a pin or axle, but can comprise any suitable arrangement for pivotably connecting the corresponding bow limb 110 to the forward riser segment 104.

Each elongated bow limb 110 is pivotably connected at its riser pivotable connection point 110*a* to the corresponding forward riser segment 104 at its pivotable connection point 104*a*. Each bow limb 110 and corresponding rearward riser segment 106 engage one another at a bearing region 200. The specific arrangement of the bearing region 200 varies among the exemplary embodiments disclosed herein, but in each example the bearing region includes a bearing member positioned at a bearing point on each of the rearward riser segments 104. Each bow limb 110 has a pulley pivotable connection point 110*b* arranged to receive a corresponding one of the pulley members 114 (e.g., a cam assembly or an idler wheel) pivotably connected thereto. Pivotable connection points 110*a* and 110*b* typically comprise transverse holes for a pin or axle, but can comprise any suitable arrangement for pivotably connecting the bow limb 110 to the corresponding forward riser segment 104, or to the corresponding pulley member 114. In FIG. 1 the first pulley member 114 comprises a first cam assembly pivotably connected to the first bow limb 110 at its pulley pivotable connection point 110*b*, while a second pulley member 114 comprises a second cam assembly pivotably connected to the second bow limb 110 at its pulley pivotable connection point 110*b*. A draw cable 130 and power cables 132 are shown engaged with the first and second cam assemblies. One or both pulley members 114 can comprise a cam assembly, an idler wheel, or other pulley member.

The bow limbs 110 typically comprise a material or a combination of materials that are deformable, and that typically are substantially resiliently deformable. Drawing the bow typically results in deformation of the bow limbs and storage of potential energy therein (typically as strain energy). This energy is supplied by the force applied while drawing the bow, and is subsequently at least partially released and transferred to the arrow as kinetic energy when the bow is shot and the limbs return to a resting, non-strained shape (typically substantially the same shape as the original non-deformed shape). Any known or hereafter-developed material or material combination can be incorporated into the bow limbs 110 while remaining within the scope of the present disclosure or appended claims, including but not limited to metals, metal alloys, polymers, composites, wood, or other suitable materials.

The "pivotable connection" between the forward riser segment 104 and the limb 110 can include any type of mechanical connection that allows a necessary or desired degree of relative angular motion between members thus connected. For example, the pivotable connection can be formed by an axle passing at least partly through each of the connected members. Each of the members pivotably connected by the axle can be configured or adapted therefor, e.g., by including at the corresponding connection point a forked portion, a slotted or recessed portion, a protruding portion, or other similar adaptation or structure for accommodating the axle. Other pivotable connections can be employed while remaining within the scope of the present disclosure or appended claims. Such connections may include but are not limited to: axles; clevis pins; other pins; hinges; articulated joints; flexure bearings or linkages; deformable integral structures (deformable only near the connection point or deformable over an extended region of one or both integral members); other suitable connections known or hereafter developed that provide a needed or desired degree of relative angular motion.

The bow limbs 110 can assume any suitable configuration. In one example, each bow limb 110 comprises a single, integral, elongated member (FIGS. 5A-5C). In another example, each bow limb 110 comprises a pair of substantially parallel, spaced-apart, elongated members (FIGS. 6A-6C). These and any other suitable bow limb configurations or arrangements shall fall within the scope of the present disclosure or appended claims.

In the drawings, FIGS. 1, 2A, 3A, 7A, 8A, 9A, and 10A illustrate arrangements when the bow is "at brace," i.e., in a resting configuration prior to drawing the bow. The heavy directional arrows in those figures indicate movement that occurs as the bow is drawn. FIGS. 2B, 3B, 7B, 8B, 9B, and 10B illustrate arrangements when the bow is drawn, and in those drawings the heavy directional arrows indicate movement that occurs after the drawn cable is released and the bow is shot. The draw cable 130, power cables 132, and cam assemblies 114 in the exemplary embodiments of the figures are arranged so that pulling the draw cable 130 to draw the bow 10 results in rotation of the pulley member 114 and deformation of the bow limbs 110 (as illustrated by the heavy directional arrows in FIGS. 2A, 7A, and 9A). The riser 102 and bow limbs 110 are arranged so that the deformation of the bow limbs 110 when the bow is drawn results in movement of the respective pulley connection points 110*b* toward one another. When the cable of the drawn bow is released to shoot the bow, the pulley members 114 rotate back to their rest positions and the bow limbs 110 return to their non-deformed shapes (as illustrated by the heavy directional arrows in FIGS. 2B, 7B, and 9B).

In the exemplary embodiment of FIGS. 2A, 2B, 3A, 3B, 4A, and 4B, a bearing member 204 is positioned on a bearing portion or bearing point 108 of the rearward riser segment 106. Bearing portion 108 includes a concave bearing surface 108*a* that engages a corresponding convex bearing surface 204*a*. Another bearing surface 204*b* of the bearing member 204 engages a mating area of the bow limb 110. As shown in the enlarged views of FIGS. 3A and 3B, deformation of the bow limb 110 when the bow is drawn causes movement of the convex bearing surface 204*a* in a forward direction along the concave bearing surface 108*a*. That motion in turn allows the bearing member 204 to rotate slightly to maintain engagement of bearing surface 204*b* with the bow limb 110 as it is deformed by drawing the bow. When the bow is shot and the bow limb 110 returns to its unstrained shape, the convex bearing surface 204*a* moves in a rearward direction along the engaged concave bearing surface 108*a*.

The bearing member 204 can comprise any suitably incompressible, resilient, durable, rigid, or friction-reducing material, examples of which can include but are not limited to nylon, polyethylene, tetrafluoroethylene, other polymers, fiberglass, other composite materials, graphite-impregnated material, lubricant-impregnated material (e.g., impregnated with petroleum- or silicone-based lubricant), metal or metal alloy, and so on. The bearing portion or bearing point 108 of the rearward riser segment 106 can be integrally formed with the riser segment 106, or can comprise a separate part that is assembled with the riser segment 106. Bearing portion 108 can comprise any material suitable for forming riser segment 106 or bearing member 204, or other suitable materials. If needed or desired, a "bearing sheet" 206 can be interposed between the engaged concave and convex bearing surfaces 204*a* and 108*a*. The sheet can comprise any material suitable for reducing friction or wear arising from movement of the bearing surfaces along one another, or can serve to absorb a portion of the shock or vibration arising from shooting the bow. The bearing sheet can comprise any material suitable for bearing member 204, bearing portion 108 of riser segment 106, or other suitable materials. The bearing sheet 206 can be integrally formed on bearing surface 108*a* or 204*a*, or can be provided as a separate part. A similar bearing sheet can be interposed between bow limb 110 and bearing member 204, if needed or desired, either integrally formed on bearing surface 204*b* or as a separate part.

The bearing member need not be secured to the bow limb 110. As the bow is drawn and the bow limb 110 deforms, movement of the bearing member 204 along the bow limb 110 can, but may not necessarily, occur (i.e., movement of the convex bearing surface 204*a* in a forward direction relative to the corresponding concave bearing surface 108 can occur without movement of the corresponding limb-bearing surface 204*b* relative to the corresponding bow limb). The tension in the cables 130 and 132 urges the bow limb 110 against the surface 204*b* of bearing member 204 and holds it in place against the bearing portion 108 of the riser segment 106. A viscous lubricant (e.g., a silicone grease) can be employed between the bearing surface 204*b* and the bow limb 110, which can hold the bearing member 204 in place if the bow is unstrung. As shown in FIGS. 5A-5C and 6A-6C, the bearing portion 108 of the rearward riser segment 106 can be further adapted to retain the bearing member 204 in place against the bow limb 110. Lateral retaining members 107 can extend from the bearing portion 108 on each side of the bearing member 204 to limit its lateral movement. The lateral retaining members 107 can extend beyond the retaining member 204 on each side of bow limb 110, if desired. FIGS. 5A-5C show an arrangement that include lateral retaining members 107 on each side of a single-piece bow limb 110. In FIGS. 6A-6C, lateral retaining members 107 are positioned on each side of each of a pair of elongated members that comprise bow limb 110.

Figure 8A:
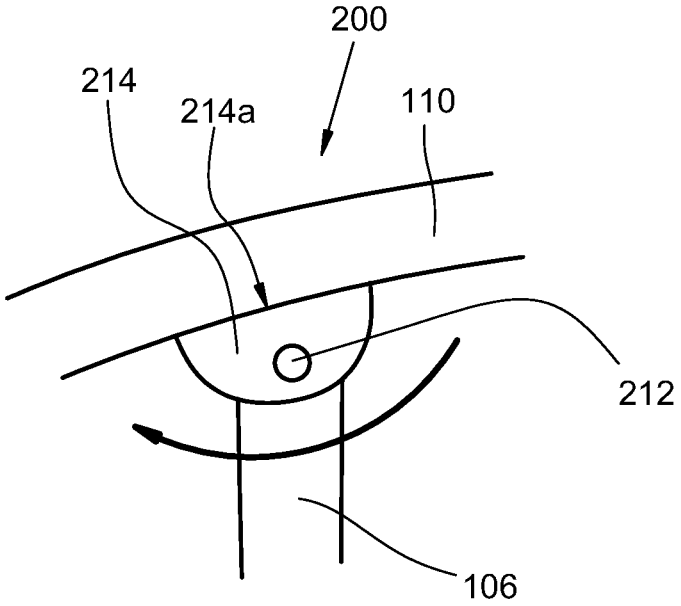
FIGS. 8A and 8B are enlarged views of corresponding portions of FIGS. 7A and 7B, respectively.
Figure 8B:
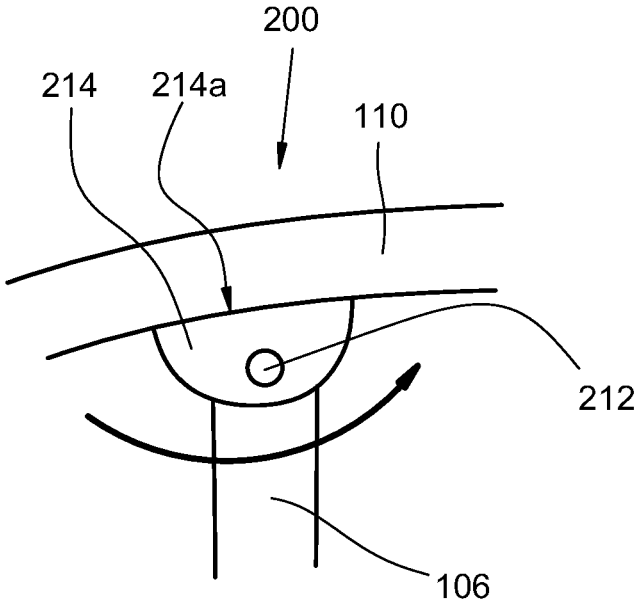
Figure 9A:
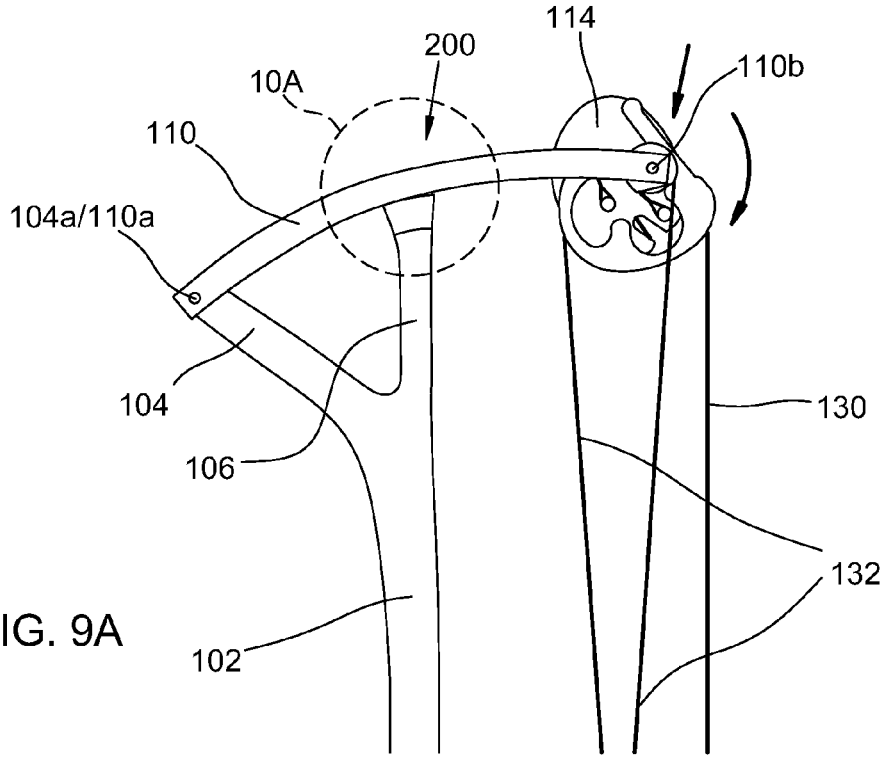
FIGS. 9A and 9B illustrate schematically another exemplary embodiment of a bow with center-bearing limbs in undrawn and drawn configurations.
Figure 9B:
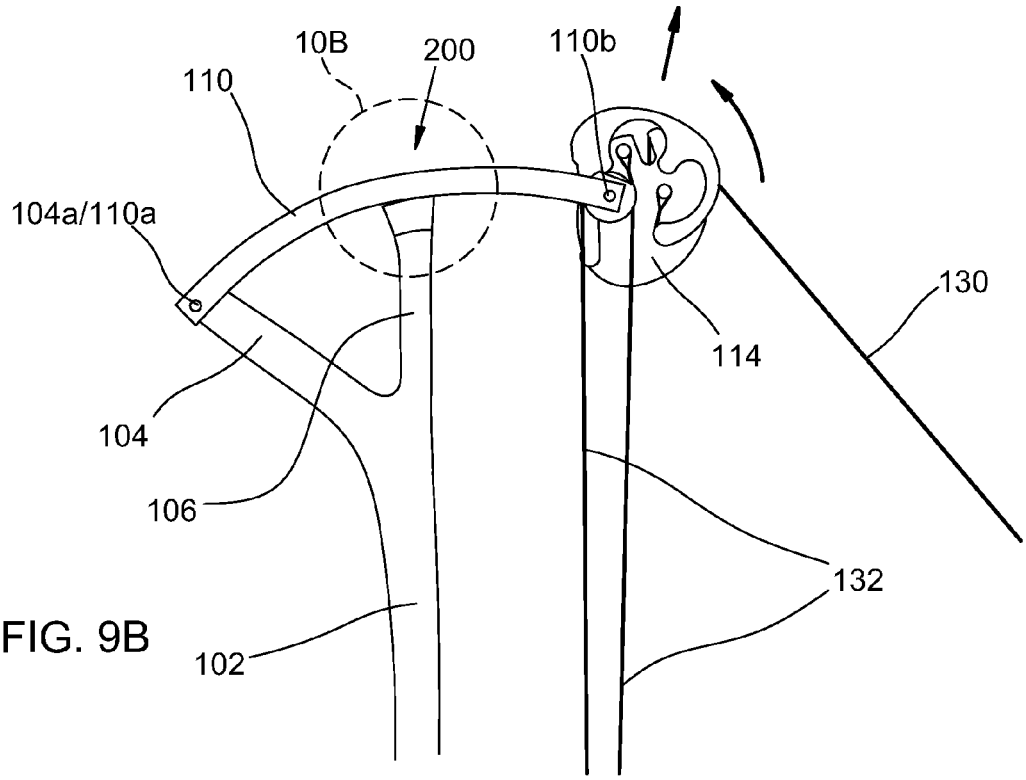

In the exemplary embodiment of FIGS. 7A, 7B, 8A, and 8B, a bearing member 214 is pivotably connected to rearward riser segment 106 at a pivotable connection point 212 that can be regarded as a bearing point. The pivotable connection can be arranged in any suitable manner, including those described above. Bearing member 214 can comprise any suitable material, including those disclosed above. Bearing surface 214*a* of the bearing member 214 engages the bow limb 110 (directly, or with an interposed bearing sheet as described above). Deformation of bow limb 110 as the bow is drawn causes rotation of the bearing member 214 as indicated in FIG. 8A, and may also result in slight movement of the bow limb 110 forward along the bearing surface 214*a*. Shooting the bow and allowing the bow limb 110 to relax to its unstrained position causes rotation of the bearing member 214 in the other direction as indicated in FIG. 8B, and also result in movement of the bearing surface 214*a* back along the bow limb 110.

Figure 10A:
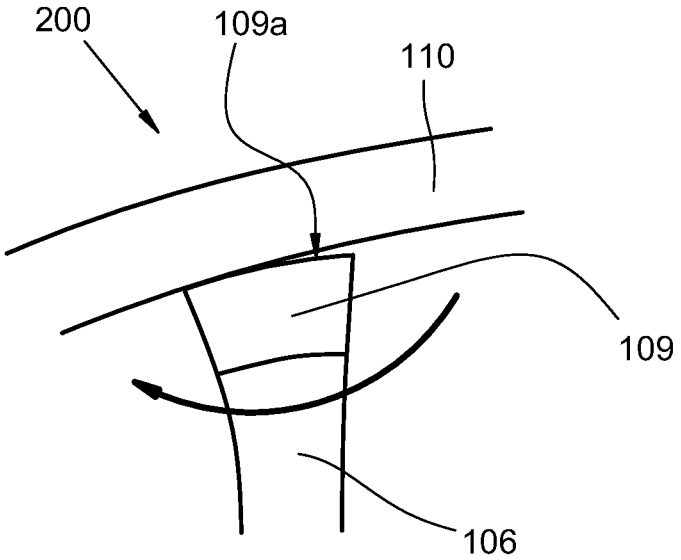
FIGS. 10A and 10B are enlarged views of corresponding portions of FIGS. 9A and 9B, respectively.
Figure 10B:
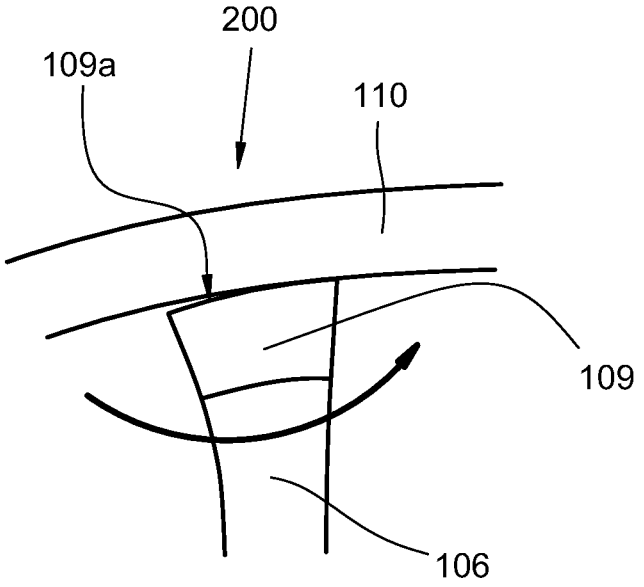

In the exemplary embodiment of FIGS. 9A, 9B, 10A, and 10B, each rearward riser segment includes a limb-bearing portion or bearing point 109 with a limb-bearing surface 109*a* formed thereon. The limb-bearing surface 109*a* in this embodiment is typically slightly convex and engages the bow limb 110 (directly, or with an interposed bearing sheet as described above). Deformation of bow limb 110 as the bow is drawn causes the point of engagement between the bow limb 110 and limb-bearing surface 109*a* to move along surface 109*a* (typically in a rearward direction) and may also cause slight rotation of the bow limb 110 (as indicated in FIG. 10A) or slight movement of the bow limb 110 forward along the bearing surface 109*a*. Shooting the bow and allowing the bow limb 110 to relax to its unstrained position causes the point of engagement to move back along surface 109*a* (typically in a forward direction) and may also cause slight rotation of the bow limb (as indicated in FIG. 10B) or slight movement of the bow limb 110 rearward along the bearing surface 109*a*.

In any of the exemplary embodiments, the bearing region 200 and its bearing point (where the bow limb 110 and the corresponding rearward riser segment 106 engage one another) can be located along the bow limb 110 about midway between the pulley and riser connection points 110*a* and 110*b*, or within about the middle eighth of the length between the limb connection points (i.e., between about 44% and about 56% of the distance between the connection points), or within about the middle quarter (i.e., between about 38% and about 62%) of the length between the limb connection points, or within about the middle third (i.e., between about 33% and about 66%) of the length between the limb connection points, or within about the middle half (i.e., between about 25% and about 75%) of the length between the limb connection points, or in any other suitable, needed, or desired position between the connection points of the bow limb. The riser connection point 110*a* and the pulley connection point 110*b* can be located at corresponding opposite ends of the bow limb 110, or at any other suitable, needed, or desired position on the bow limb. Distances between connection or bearing "points" can be ambiguous when at least one of the points in question is an extended area or region. In that case, the position of the "point" can be regarded as the point where an effective force would be applied that is equivalent to the net force distributed over the extended area or region. For example, a pivotable connection point that comprises a cylindrical pin would be considered to be located at the axis of the pin. In another example, a rectangular bearing point having a force uniformly distributed over its area would be considered to be located at the center of the rectangle.

Figure 11A:
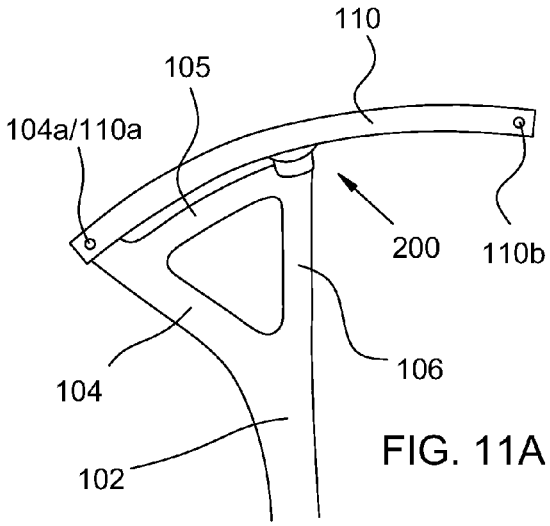
FIGS. 11A-11F illustrate schematically alternative arrangements of the riser and bow limb.
Figure 11B:
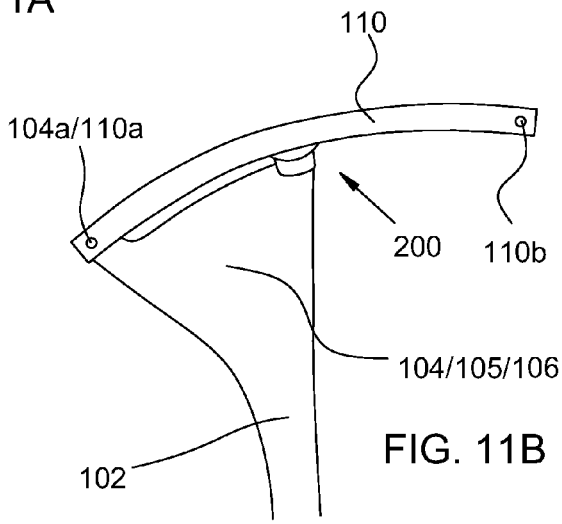
Figure 11C:
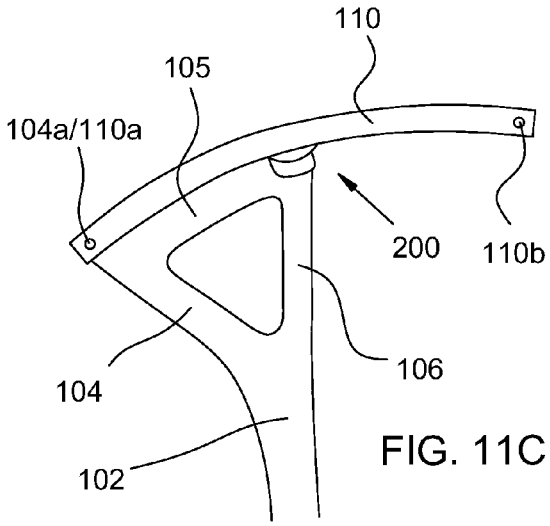
Figure 11D:
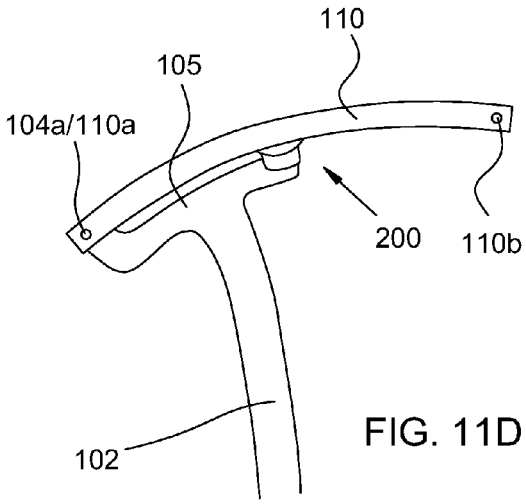
Figure 11E:
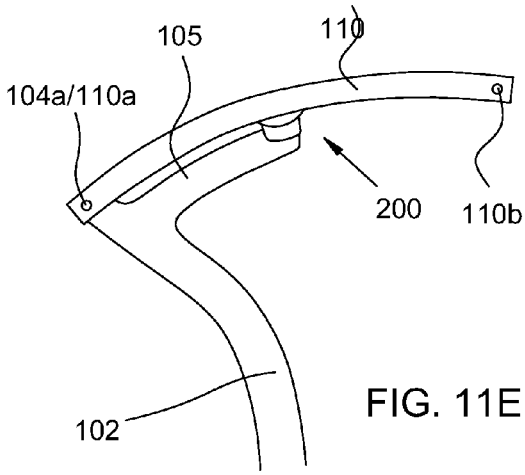
Figure 11F:
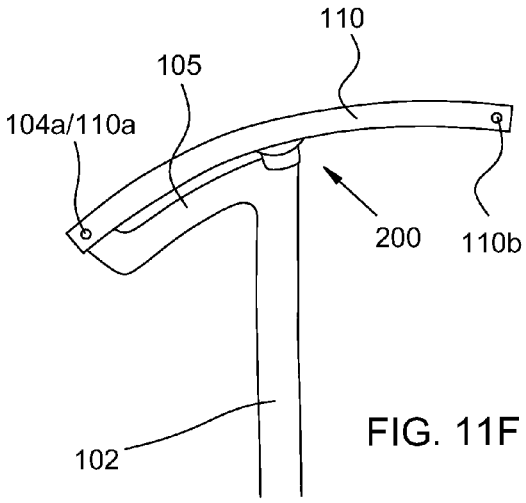

FIGS. 11A-11F illustrate schematically various alternative arrangements of the connection point 104*a* and bearing region 200 (including a bearing point or portion) on riser 102. In the preceding embodiments, connection point 104*a* is positioned on forward riser segment 104 and the bearing point is positioned on rearward riser segment 106. The connection and bearing points are substantially rigidly positioned on the riser 102 as a result of the substantially rigid connection between riser segments 104/106 and riser 102 (integrally formed or rigidly connected parts). In FIG. 11A, an additional cross member 105 connects the riser segments 104/106. In FIG. 11B, the riser segments 104/106 and cross member 105 form a fused, unitary structure. In FIGS. 11D-11F, the riser segments 104/106 are omitted entirely, and the cross member 105 is connected directly to riser 102 and carries the connection point 104*a* and bearing region 200 with the bearing point. Three differing arrangements are shown with the riser connected near the center of the cross member 105 in a "T" arrangement (FIG. 11D) or near the front or back end of cross member 105 in an inverted "L" arrangement (FIGS. 11E and 11F, respectively).

In most of the illustrated embodiments, there is no contact or engagement between the riser and the bow limb along the length of the bow limb between the connection and bearing points, and that arrangement may be preferred in many circumstances. Alternatively, as illustrated schematically in FIG. 11C, in some embodiments at least a portion of the cross member 105 can make contact with an adjacent portion of the bow limb between the connection and bearing points (direct contact or indirect contact via an intervening layer or structure). Such contact would typically occur with the bow undrawn; upon drawing, the contacting portion of the bow limb between the connection and bearing points would typically deform and move away from the cross member.

Bow-limbs configured according to the present disclosure (i.e., so-called "center-bearing" limbs) can provide one or more advantages over previous bow limbs (referred to herein as "end-pivot" for convenience). End-pivot limbs typically are secured at one end thereof to the riser. This results in localized forces and stresses on the limb that are substantially magnified by the lever arm of the limb (roughly, the overall limb length divided by the limb length in contact with the riser). By placing the bearing region 200 relatively nearer to the center of the limb 110, such shear localized forces and stresses can be reduced substantially without substantially reducing the energy stored by deformation of the limbs 110. Magnification can be substantially eliminated by centering the bearing region 200 between pivot points 110*a* and 110*b*. Placement of the bearing region 200 relatively nearer to the center of limbs 110 can result in a reduced bending moment and therefore in an increased effective stiffness-to-mass ratio. The effective moment of inertia for motion of the limb about its pivot point can be reduced by up to almost one-half for a center-bearing limb relative to an end-pivot limb. The reduced moment of inertia can result in less stored potential energy of the drawn bow being wasted as kinetic energy of limb movement. The location of bearing region 200 relatively nearer to the center of limb 110 typically shifts the resonance frequency of the limb upward, which can result in reduced limb vibrations (relative to an end-pivot limb). In addition to positioning the bearing region 200 near the center of the limb 110, in some instances it can also be advantageous to arrange the limb 110 with a mass or stiffness distribution that is substantially symmetric about the bearing region 200. It has been observed that such an arrangement appears to reduce vibration of the bow limb during firing of the bow.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims. In addition to the exemplary embodiments explicitly disclosed and shown, other arrangements of the bearing region 200 (including various arrangements of the bow limb, bearing member, rearward riser segment, or connection/bearing points) that enable similar sorts of deformation and movement of the bow limbs shall also fall within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives.

For purposes of the present disclosure and appended claims, the words "comprise", "comprising", "include", "including", "have", "having" and so on are intended as open-ended terminology, with the same meaning as if the phrase "at least" were appended after each instance thereof.

What is claimed is:

1. An archery bow comprising:

an elongated, substantially rigid riser having a central portion and first and second end portions extending from opposite ends of the central portion, each of the end portions including a corresponding forward pivotable connection point and rearward bearing point, said connection and bearing points being substantially rigidly positioned on the corresponding end portion;

a first bearing member positioned on the first riser end portion at its rearward bearing point;

a first elongated, resilient bow limb having a riser pivotable connection point and a pulley pivotable connection point, the first bow limb being (i) pivotably connected at its riser connection point to the first riser end portion at its forward pivotable connection point, (ii) positioned against the first bearing member at a point along the first bow limb between its riser and pulley connection points that is displaced from the riser connection point by at least one third of the distance between the riser and pulley connection points, and (iii) arranged at its pulley pivotable connection point to receive a pulley member pivotably connected thereto;

a second bearing member positioned on the second riser end portion at its rearward bearing point; and a second elongated, resilient bow limb having a riser pivotable connection point and a pulley pivotable connection point, the second bow limb being (i) pivotably connected at its riser connection point to the second riser end portion at its forward pivotable connection point, (ii) positioned against the second bearing member at a point along the second bow limb between its riser and pulley connection points that is displaced from the riser connection point by at least one third of the distance between the riser and pulley connection points, and (iii) arranged at its pulley pivotable connection point to receive a pulley member pivotably connected thereto, wherein:

each rearward bearing point includes a concave bearing surface; and each bearing member includes (i) a convex bearing surface engaged with the concave bearing surface of the corresponding rearward bearing point, and (ii) a limb-bearing surface engaged with a mating area of the corresponding bow limb.

2. The bow of claim 1 wherein:

the first bearing member is positioned against the first bow limb at a position within about the middle third of the length along the first bow limb between its riser and pulley connection points; and the second bearing member is positioned against the second bow limb at a position within about the middle third of the length along the second bow limb between its riser and pulley connection points.

3. The bow of claim 1 wherein:

the first bearing member is positioned against the first bow limb at a position within about the middle eighth of the length along the first bow limb between its riser and pulley connection points; and the second bearing member is positioned against the second bow limb at a position within about the middle eighth of the length along the second bow limb between its riser and pulley connection points.

4. The bow of claim 1 wherein each riser end portion comprises corresponding forward and rearward substantially rigid riser segments substantially rigidly connected to the riser central portion, each forward pivotable connection point is positioned on the forward riser segment of the corresponding riser end portion, and each rearward bearing point is positioned on the rearward riser segment of the corresponding riser end portion.

5. The bow of claim 1 wherein each bow limb comprises a corresponding pair of substantially parallel, spaced-apart, elongated members.

6. The bow of claim 1 wherein the bow is structurally arranged so that deformation of the bow limbs toward one another causes movement of each convex bearing surface in a forward direction relative to the corresponding concave bearing surface without movement of the corresponding limb-bearing surface relative to the corresponding bow limb.

7. The bow of claim 1 further comprising a bearing sheet interposed between the engaged convex and concave bearing surfaces.

8. The bow of claim 1 wherein each bow limb is pivotably connected to the corresponding riser end portion by a corresponding axle, pin, clevis pin, hinge, articulated joint, flexure bearing or linkage, or deformable integral structure.

9. The bow of claim 1 further comprising:

a first pulley member pivotably connected to the first bow limb at the pulley pivotable connection point thereof;

a second pulley member pivotably connected to the second bow limb at the pulley pivotable connection point thereof; and a draw cable engaged with the first and second pulley members, wherein:

the first or second pulley member and the engaged draw cable are arranged so that pulling the draw cable to draw the bow results in deformation of the first and second bow limbs;

the riser, the first bow limb, and the second bow limb are arranged so that said deformation of the first and second bow limbs results in movement of the corresponding pulley pivotable connection points toward one another;

the connection and bearing points of the first end portion of the riser, the first bow limb, and the first bearing member are arranged so that said deformation of the first bow limb results in movement of the first bow limb relative to the corresponding bearing point with the first bearing member between them; and the connection and bearing points of the second end portion of the riser, the second bow limb, and the second bearing member are arranged so that said deformation of the second bow limb results in movement of the second bow limb relative to the second corresponding bearing point with the second bearing member between them.

10. A method for making an archery bow comprising:

providing an elongated, substantially rigid riser having a central portion and first and second end portions extending from opposite ends of the central portion, each of the end portions including a corresponding forward pivotable connection point and a rearward bearing point, said connection and bearing points being substantially rigidly positioned on the corresponding end portion;

pivotably connecting a first elongated bow limb at a riser pivotable connection point thereof to the first riser end portion at its forward pivotable connection point, the first bow limb being arranged at a pulley pivotable connection point thereof to receive a pulley member pivotably connected thereto;

pivotably connecting a second elongated bow limb at a riser pivotable connection point thereof to the second riser end portion at its forward pivotable connection point, the second bow limb being arranged at a pulley pivotable connection point thereof to receive a pulley member pivotably connected thereto;

positioning a first bearing member on the first riser end portion at its rearward bearing point and positioning the first bow limb against the first bearing member at a point along the first bow limb between its riser and pulley connection points that is displaced from the riser connection point by at least one third of the distance between the riser and pulley connection points; and positioning a second bearing member on the second riser end portion at its rearward bearing point and positioning the second bow limb against the second bearing member at a point along the second bow limb between its riser and pulley connection points that is displaced from the riser connection point by at least one third of the distance between the riser and pulley connection points, wherein:

each rearward bearing point includes a concave bearing surface; and each bearing member includes (i) a convex bearing surface engaged with the concave bearing surface of the corresponding rearward bearing point, and (ii) a limb-bearing surface engaged with a mating area of the corresponding bow limb.

11. The method of claim 10 wherein:

the first bearing member is positioned against the first bow limb at a position within about the middle third of the length along the first bow limb between its riser and pulley connection points; and the second bearing member is positioned against the second bow limb at a position within about the middle third of the length along the second bow limb between its riser and pulley connection points.

12. The method of claim 10 wherein:

the first bearing member is positioned against the first bow limb at a position within about the middle eighth of the length along the first bow limb between its riser and pulley connection points; and the second bearing member is positioned against the second bow limb at a position within about the middle eighth of the length along the second bow limb between its riser and pulley connection points.

13. The method of claim 10 wherein each riser end portion comprises corresponding forward and rearward substantially rigid riser segments substantially rigidly connected to the riser central portion, each forward pivotable connection point is positioned on the forward riser segment of the corresponding riser end portion, and each rearward bearing point is positioned on the rearward riser segment of the corresponding riser end portion.

14. The method of claim 10 wherein each bow limb comprises a corresponding pair of substantially parallel, spaced-apart, elongated members.

15. The method of claim 10 wherein the bow is structurally arranged so that deformation of the bow limbs toward one another causes movement of each convex bearing surface in a forward direction relative to the corresponding concave bearing surface without movement of the corresponding limb-bearing surface relative to the corresponding bow limb.

16. The method of claim 10 further comprising interposing a bearing sheet between the engaged convex and concave bearing surfaces.

17. The method of claim 10 wherein each bow limb is pivotably connected to the corresponding riser end portion by a corresponding axle, pin, clevis pin, hinge, articulated joint, flexure bearing or linkage, or deformable integral structure.

18. The method of claim 10 further comprising:

pivotably connecting a first pulley member to the first bow limb at the pulley pivotable connection point thereof;

pivotably connecting a second pulley member to the second bow limb at the pulley pivotable connection point thereof; and engaging a draw cable with the first and second pulley members, wherein:

the first or second pulley member and the engaged draw cable are arranged so that pulling the draw cable to draw the bow results in deformation of the first and second bow limbs;

the riser, the first bow limb, and the second bow limb are arranged so that said deformation of the first and second bow limbs results in movement of the corresponding pulley pivotable connection points toward one another;

the connection and bearing points of the first end portion of the riser, the first bow limb, and the first bearing member are arranged so that said deformation of the first bow limb results in movement of the first bow limb relative to the corresponding bearing point with the first bearing member between them; and the connection and bearing points of the second end portion of the riser, the second bow limb, and the second bearing member are arranged so that said deformation of the second bow limb results in movement of the second bow limb relative to the second corresponding bearing point with the second bearing member between them.

* * * * *